US012234832B2

(12) United States Patent
Flueckiger et al.

(10) Patent No.: US 12,234,832 B2
(45) Date of Patent: Feb. 25, 2025

(54) IMPELLER WHEEL OF A CENTRIFUGAL PUMP

(71) Applicant: Frideco AG, Neunkirch (CH)

(72) Inventors: Patrick Flueckiger, Neunkirch (CH); Andreas Bruno Würms, Neunkirch (CH)

(73) Assignee: Frideco AG, Neunkirch (CH)

( * ) Notice: Subject to any disclaimer, the term of this patent is extended or adjusted under 35 U.S.C. 154(b) by 0 days.

(21) Appl. No.: 18/029,581

(22) PCT Filed: Sep. 30, 2021

(86) PCT No.: PCT/EP2021/077026

§ 371 (c)(1),
(2) Date: Mar. 30, 2023

(87) PCT Pub. No.: WO2022/069676

PCT Pub. Date: Apr. 7, 2022

(65) Prior Publication Data

US 2023/0366411 A1 Nov. 16, 2023

(30) Foreign Application Priority Data

Oct. 2, 2020 (CH) ..... 1256/20

(51) Int. Cl.
*F04D 29/22* (2006.01)
*F04D 1/00* (2006.01)

(52) U.S. Cl.
CPC ..... *F04D 29/2216* (2013.01); *F04D 1/00* (2013.01)

(58) Field of Classification Search
CPC .... F04D 29/2216; F04D 29/28; F04D 29/281; F04D 29/24
See application file for complete search history.

(56) References Cited

U.S. PATENT DOCUMENTS 8,814,541 B2 * 8/2014 Omori ..... F04D 29/0467 417/423.1
2004/0091354 A1 * 5/2004 Araki ..... F04D 29/183 415/206
2018/0291928 A1 10/2018 Kenworthy et al.

FOREIGN PATENT DOCUMENTS

EP 0834326 A2 4/1998
EP 2407188 A1 1/2012
EP 2952685 A1 12/2015

OTHER PUBLICATIONS

International Search Report for International Patent Application No. PCT/EP2021/077026, mailed Jan. 14, 2022 (2 pages of English Translation).

(Continued)

*Primary Examiner* — Michael L Sehn
(74) *Attorney, Agent, or Firm* — Womble Bond Dickinson (US) LLP

(57) ABSTRACT

An impeller wheel, in particular for a centrifugal pump, has in at least one side view perpendicular to a rotary axis an outer contour that is spaced apart radially from the rotary axis, the outer contour comprising a first contour line which is inclined relative to the rotary axis by a first angle, and comprising a second contour line which directly follows the first contour line and is inclined relative to the rotary axis by a second angle, the second angle being by at least 0.05° and maximally 2° smaller than the first angle.

14 Claims, 1 Drawing Sheet

(56) References Cited

OTHER PUBLICATIONS

International Preliminary Report and Written Opinion on the Patentability of Application No. PCT/EP2021/077026, Mailed Mar. 28, 2023, 9 pages.

* cited by examiner

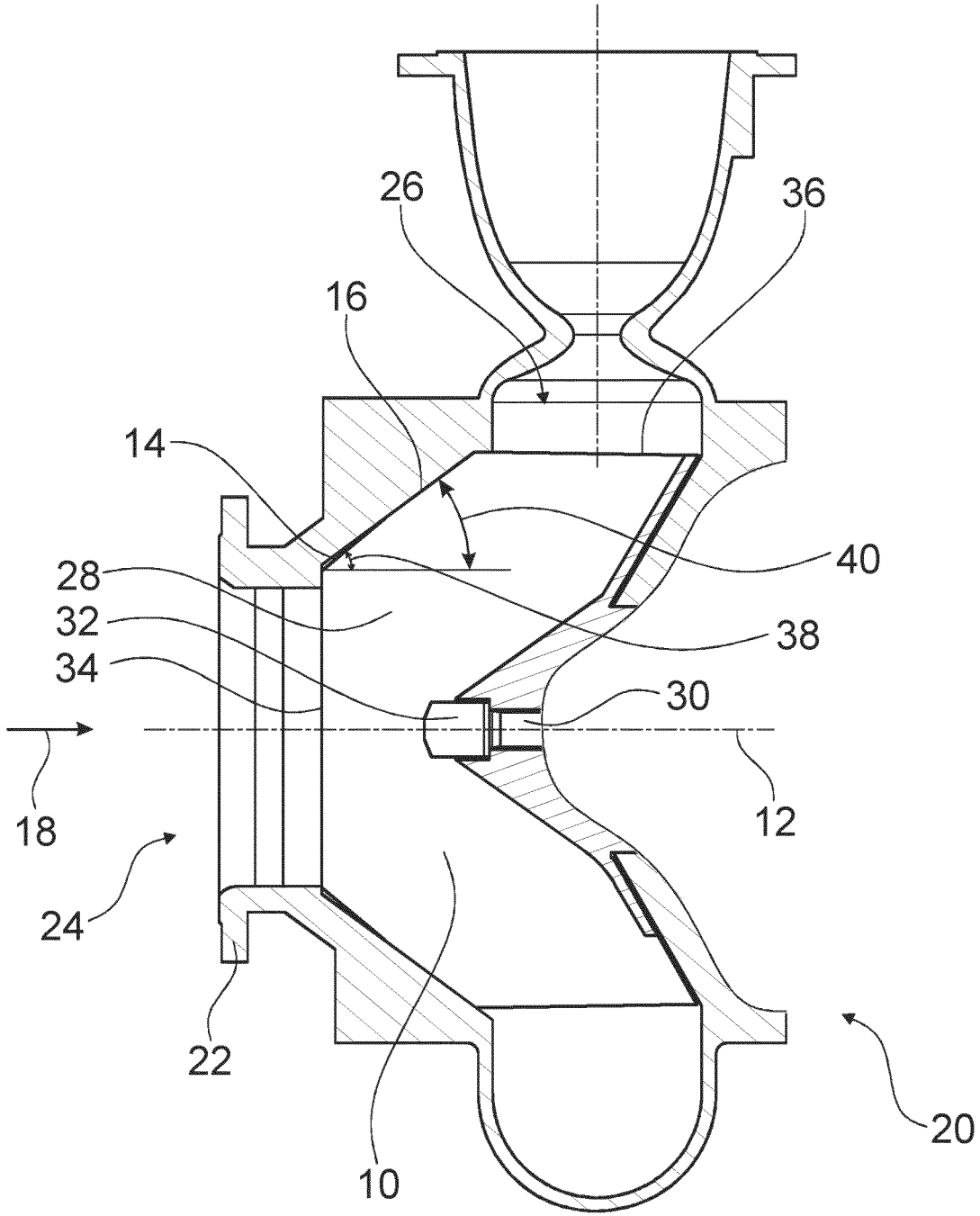
26
36
16
14
40
28
38
32
34
30
18
12
24
22
20
10

IMPELLER WHEEL OF A CENTRIFUGAL PUMP

CROSS-REFERENCE TO RELATED APPLICATIONS

This patent application is based on and incorporates herein by reference the Swiss patent application CH 01256/20, filed on Oct. 2, 2020, and the international patent application PCT/EP2021/077026, filed on Sep. 30, 2021.

The invention relates to an impeller wheel and to a centrifugal pump with such an impeller wheel.

Centrifugal pumps with impeller wheels having a conical meridional-section contour are already known from the prior art.

The objective of the invention is in particular, but not limited to, providing an impeller wheel having improved properties with regard to its construction. The objective is achieved according to the invention.

An impeller wheel, in particular for a centrifugal pump, is proposed, having in at least one side view perpendicular to a rotary axis of the impeller wheel an outer contour which is spaced apart from the rotary axis, comprising a first contour line which is inclined relative to the rotary axis by a first angle, and comprises a second contour line directly following the first contour line, which is inclined relative to the rotary axis in the same direction by a second angle, the second angle being by at least 0.05° and maximally 2° smaller than the first angle.

Such an implementation allows providing an impeller wheel having improved properties with regard to its construction. It is furthermore in particular possible to achieve an improved assembly and an increased efficiency rate. Advantageously, a gap between the impeller wheel and a conveying unit of a pump comprising the impeller wheel, in particular a regulating conus or wear ring, can be realized in such a way that it is larger near an entry region of the impeller wheel than near an exit region of the impeller wheel, which allows improving a performance and/or an efficiency rate. Especially advantageously, it is possible to simplify a correct alignment of the impeller wheel during assembly.

The impeller wheel may in particular be embodied as an open impeller wheel or as a closed impeller wheel. Preferably the impeller wheel has a third contour line, facing in an operating state a fluid that flows toward the impeller wheel. Particularly preferentially, in the side view the first contour line directly follows the third contour line. Advantageously the impeller wheel has a fourth contour line, facing in an operating state toward a fluid that flows away from the impeller wheel. Especially advantageously, in the side view the second contour line directly follows the fourth contour line. In particular, the impeller wheel has a fifth contour line, facing in the operating state towards a shaft which drives the impeller wheel. Preferentially the impeller wheel has at least a shaft receptacle, in particular a hub, in the region of the fifth contour line, said shaft receptacle, in particular hub, defining the rotary axis around which the impeller wheel is rotatable in the operating state.

The impeller wheel advantageously comprises at least one impeller wheel vane, which is implemented in a plate shape and is configured for conveying the fluid in the operating state.

An "outer contour" is to mean an edging of an object in a predefined view. The contour lines are herein realized as straight sections of the outer contour.

"Configured" is to mean specifically designed and/or equipped. By an object being configured for a certain function is to be understood that the object fulfills and/or executes said certain function in at least one application state and/or operation state.

It is further proposed that viewed along a flow-in direction, the first contour line is situated upstream of the second contour line. The flow-in direction is to be understood as a direction along which the fluid flows toward the impeller wheel in the operating state. In particular, a fluid flowing along the flow-in direction contacts the impeller wheel in a region of the first contour line before contacting the impeller wheel in a region of the second contour line. This allows even further improving a performance and/or an efficiency rate.

Beyond this it is proposed that in the side view a first extension of the first contour line parallel to the rotary axis is at least 20% and maximally 50% of a second extension of the second contour line parallel to the rotary axis. The extensions of the contour lines parallel to the rotary axis are in each case equivalent to the length of a projection of the contour line onto the rotary axis. This allows improving a performance and/or an efficiency rate even further. It is advantageously possible to further simplify a correct alignment of the impeller wheel during assembly.

Particularly preferentially the first extension amounts to 33% of the second extension. This allows improving a performance and/or an efficiency rate even further. As a result, it is advantageously possible to further simplify a correct alignment of the impeller wheel during assembly.

It is moreover proposed that the second angle is at least 5° and maximally 60°. This allows further improving a performance and/or an efficiency rate. As a result, in particular an advantageous shape of the outer contour in the side view is achievable.

Advantageously the second angle is smaller than the first angle by 0.2°, allowing even further improvement of a performance and/or an efficiency rate. It is advantageously possible to further simplify a correct alignment of the impeller wheel during assembly. As a result, it is in particular possible to realize a bend in the outer contour in an advantageous manner.

Finally, a centrifugal pump with an impeller wheel is proposed. This allows providing a centrifugal pump having improved properties with regard to its construction. It is thus advantageously possible to improve a performance and/or an efficiency rate of the centrifugal pump. In particular, an assembly of the centrifugal pump can be simplified in this way.

The impeller wheel is here not to be restricted to the application and implementation described above. In particular, for the purpose of fulfilling a functionality that is described here, the impeller wheel may comprise a number of individual elements, components and units that differs from a number given here.

Further advantages will become apparent from the following description of the drawing. In the drawing one exemplary embodiment of the invention is illustrated. The drawing, the description and the claims contain a plurality of features in combination. Someone skilled in the art will purposefully also consider the features separately and will find further advantageous combinations.

It is shown in:

FIG. 1 a centrifugal pump with an impeller wheel in a partial sectional view.

FIG. 1 shows a portion of a centrifugal pump 20 in a side view. The centrifugal pump 20 serves for conveying a fluid (not shown). The centrifugal pump 20 comprises a conveying unit 22. The conveying unit 22 has an entry opening 24. The entry opening 24 serves for letting a fluid pass that flows into the centrifugal pump 20 along a flow-in direction 18. The conveying unit 22 has an exit opening 26. The exit opening 26 serves for letting a fluid pass that flows out of the centrifugal pump 20.

The centrifugal pump 20 comprises an impeller wheel 10. The impeller wheel 10 comprises an impeller wheel vane 28. The impeller wheel vane 28 is realized in a plate shape. The impeller wheel 10 has a third contour line 34. The third contour line 34 faces the fluid that flows into the centrifugal pump 20. The impeller wheel 10 has a fourth contour line 36. The fourth contour line 36 faces the fluid that flows out of the centrifugal pump 20.

The centrifugal pump 20 comprises a shaft 30. The shaft 30 serves for driving the impeller wheel 10. The impeller wheel 10 comprises a shaft receptacle 32. The shaft receptacle 32 is embodied as a hub. The shaft receptacle 32 defines a rotary axis 12. The impeller wheel 10 is supported rotatably around the rotary axis 12. A view direction of the side view extends perpendicularly to the rotary axis 12.

The impeller wheel 10 has an outer contour that is radially spaced apart from the rotary axis 12. The outer contour comprises a first contour line 14. The first contour line 14 directly follows the third contour line 34. The first contour line 14 is inclined by a first angle 38 relative to the rotary axis 12. The first angle 38 is approximately 40°.

The outer contour comprises a second contour line 16. The second contour line 16 directly follows the fourth contour line 36. The second contour line 16 directly follows the first contour line 14. Viewed along the flow-in direction 18, the first contour line 14 is situated upstream of the second contour line 16. The second contour line 16 is inclined by a second angle 40 relative to the rotary axis 12, in the same direction. The second angle 40 is smaller than the first angle 38 by 0.2°. The second angle 40 is approximately 39.8°.

The first contour line 14 has a first extension parallel to the rotary axis 12. The second contour line 16 has a second extension parallel to the rotary axis 12. The first extension amounts to 33% of the second extension.

Alternatively, the first angle 38 and the second angle 40 may have other values, wherein the second angle 40 is at least 5° and maximally 60° and is smaller than the first angle 38 by at least 0.05° and by maximally 2°. Depending on the angles 38, 40 selected for the contour lines 14, 16, the ratio of the extensions of the contour lines 14, 16 with respect to the rotary axis 12 may change.

REFERENCE NUMERALS

10 impeller wheel
12 rotary axis
14 first contour line
16 second contour line
18 flow-in direction
20 centrifugal pump
22 conveying unit
24 entry opening
26 exit opening
28 impeller wheel vane
30 shaft
32 shaft receptacle
34 third contour line
36 fourth contour line
38 first angle
40 second angle

The invention claimed is:

1. An impeller wheel having in at least one side view perpendicular to a rotary axis an outer contour that is spaced apart radially from the rotary axis, the outer contour comprising a first contour line which is inclined relative to the rotary axis by a first angle, and comprising a second contour line which directly follows the first contour line and is inclined relative to the rotary axis by a second angle, the second angle being by at least 0.05° and maximally 2° smaller than the first angle, wherein in the side view a first extension of the first contour line parallel to the rotary axis is at least 20% and maximally 50% of a second extension of the second contour line parallel to the rotary axis.

2. The impeller wheel according to claim 1, wherein when viewed along a flow-in direction, the first contour line is situated upstream of the second contour line.

3. The impeller wheel according to claim 1, wherein the first extension amounts to 33% of the second extension.

4. The impeller wheel according to claim 1, wherein the second angle is at least 5° and maximally 60°.

5. The impeller wheel according to claim 1, wherein the second angle is smaller than the first angle by 0.2°.

6. A centrifugal pump with the impeller wheel according to claim 1.

7. The impeller wheel according to claim 1, wherein the second contour line connects to the first contour line.

8. The impeller wheel according to claim 1, wherein the first contour line and the second contour line are located on a same side of an impeller wheel vane of the impeller wheel.

9. The impeller wheel according to claim 1, wherein the first contour line and the second contour line realize a bend in the outer contour.

10. The impeller wheel according to claim 1, wherein the outer contour comprises a third contour line that crosses the rotary axis.

11. The impeller wheel according to claim 10, wherein the first contour line directly follows the third contour line in the side view.

12. The impeller wheel according to claim 1, wherein the outer contour comprises a third contour line extending perpendicularly to the rotary axis.

13. The impeller wheel according to claim 12, wherein the first contour line directly follows the third contour line in the side view.

14. The impeller wheel according to claim 1, wherein the first angle is approximately 40°.

* * * * *